United States Patent [19]

Zechlin

[11] 4,211,195

[45] Jul. 8, 1980

[54] OVERSPEED IGNITION SYSTEM

[75] Inventor: Richard Zechlin, Beloit, Wis.

[73] Assignee: Colt Industries Operating Corp., New York, N.Y.

[21] Appl. No.: 841,584

[22] Filed: Oct. 12, 1977

[51] Int. Cl.[2] ..... F02P 1/00

[52] U.S. Cl. ..... 123/335; 123/596

[58] Field of Search ..... 123/118, 117 R, 148 CB, 123/148 CC, 148 E, 102

[56] References Cited

U.S. PATENT DOCUMENTS

| | | | |
|---|---|---|---|
| 3,738,340 | 6/1973 | Olson | 123/118 |
| 3,776,204 | 12/1973 | Harris | 123/118 |
| 3,863,616 | 2/1975 | Wood | 123/118 |
| 3,967,604 | 7/1976 | Kondo | 123/118 |
| 4,010,726 | 3/1977 | Kondo et al. | 123/118 |
| 4,058,106 | 11/1977 | Drews et al. | 123/118 |

*Primary Examiner*—Gerald L. Brigance

*Attorney, Agent, or Firm*—Sixbey, Friedman & Leedom

[57] ABSTRACT

The overspeed ignition system includes trigger means operative in timed relation to the speed of an internal combustion engine. A controlled switching means operates under the control of the trigger means to pass pulses of energy to a spark ignition unit. An overspeed cutout assembly is provided between the controlled switching means and the spark ignition unit to sense the time interval between the pulses of energy passed by the controlled switching means. When this time interval is less than an internal timed lockout interval determined by the overspeed cutout assembly, the cutout assembly blocks the pulses of energy to the spark ignition unit.

The trigger means is formed by a trigger pulse generating assembly having a rotor of circular cross section symmetrically mounted for rotation relative to at least one trigger coil. The rotor is differentially magnetized to prevent pulses of energy from passing to the spark ignition unit when the engine rotates in a reverse direction. This rotor is part of a novel flux conducting flywheel unit which forms part of the flux path for the rotor to enhance the pulse generating capability of the trigger pulse generating assembly.

7 Claims, 8 Drawing Figures

OVERSPEED IGNITION SYSTEM

BACKGROUND OF THE INVENTION

Ignition system development for spark ignited engines has resulted in the design of various breakerless ignition systems wherein mechanical breakers are replaced by solid state electronic switches controlled by a trigger signal. These systems are not subject to the mechanical wear and deterioration to which mechanicl breaker systems are normally subjected and consequently, the solid state breakerless ignition systems are generally more reliable.

Capacitive discharge distributor-less ignition systems have been developed for use with internal combustion engines of all sizes from single cylinder to multicylinder engines, but extensive use of these ignition systems has been made with small internal combustion engines having two, three or four cylinders. In these small engines, it is often desirable to regulate engine speed to prevent the existance of an overspeed condition, but often the costs involved in providing additional engine governing equipment are not warranted.

In internal combustion engines employing a capacitive discharge ignition system, it is desirable to provide structure which will inhibit the engine from rotating in the reverse direction. This has been accomplished in the past through the use of trigger pulse forming pulser rotors of a type illustrated by U.S. Pat. No. 3,741,185 to Thomas E. Swift et al constructed of three elements to provide a rotor having a tapering cross-section. Another non-symmetrically formed pulser rotor is disclosed by U.S. Pat. No. 3,799,137 to K. Reddy wherein the rotor has a periphery formed substantially as a convolution of a spiral. These patented pulser rotors alter the trigger pulse which is normally provided to a capacitor discharge ignition system when the internal combustion engine rotates in a reverse direction, thereby disabling the ignition system. However, these non-symmetrical pulser rotors result in rotor imbalance which increases the wear of the mechanical parts associated therewith.

Prior pulser rotors have normally been mounted upon aluminum flywheels which do not provide a good path for magnetic flux. This requires that a strong magnetic source be provided by the rotor if effective triggering pulses are to be generated. To alleviate this difficiency, some rotors have been mounted upon flux conducting flywheels, but additional flux conducting spider assemblies have been necessitated to complete a flux path between a trigger coil and the flux conducting flywheel. These spider assemblies contribute both added bulk and expense to the trigger pulse generating unit.

SUMMARY OF THE INVENTION

The ignition system of the present invention includes a controlled switching means connected between an energy source and a spark ignition assembly so that a trigger means operating in timed relation to the speed of an internal combustion engine causes the controlled switching means to pass pulses of energy to the spark ignition assembly. An overspeed control unit connected between the controlled switching means and the spark ignition assembly senses the time interval between pulses of energy passed by the controlled switching means and prevents a pulse of energy from reaching the spark ignition assembly when the time interval between the pulse and the next preceeding pulse is less than a predetermined time.

The trigger means for the ignition system includes a pulser rotor of magnetic material which is substantially circular in cross section and is mounted for rotation in a desired direction and a reverse direction. A slot is formed in the pulser rotor to extend radially from the periphery thereof toward the center, and the rotor is magnetized to provide opposite polarities on opposite sides of the slot. This magnetization decreases in intensity from points of maximum magnetization adjacent each side of the slot to an area of minimal magnetization substantially 180 degrees from the slot.

The pulser rotor is mounted upon the central hub of a flux conducting flywheel which is designed to surround both a trigger coil assembly and a stator assembly. The flywheel is constructed to maintain the stator assembly, trigger coil assembly and pulser rotor in close proximity so that a flux path for the pulser rotor and trigger coil assembly is formed through the flywheel without the use of flux conducting spider assemblies or other additional flux path forming units.

It is a primary object of the present invention to provide a novel and improved ignition system for initiating spark ignition of an internal combustion engine which includes an overspeed sensing circuit. This overspeed sensing circuit operates to disable the ignition system during periods of engine overspeed to slow the engine.

Another object of the present invention is to provide a novel and improved ignition system for an internal combustion engine which is provided with a trigger pulse unit including a symmetrical pulser rotor of circular cross section operative to alter the trigger pulses for the ignition system when the rotor is rotated in a direction opposite to the normal direction of rotation to inhibit the engine from rotating in a reverse direction.

A further object of the present invention is to provide a novel and improved capacitive discharge ignition system for internal combustion engines which includes solid state components to provide a static system for spark ignition control and engine speed control.

A still further object of the present invention is to provide a novel and improved ignition system for an internal combustion engine wherein a rotor, one or more trigger coils, a stator and a flux conducting flywheel are arranged in close proximity to form a flux path for a trigger pulse generating unit without the use of flux conducting spider assemblies or additional units to complete a flux path.

These and other objects of the present invention will become readily apparent from a consideration of the following specification and claims taken in conjunction with the accompanying drawings in which:

FIG. 1 is a circuit diagram of the ignition system of the present invention including an overspeed cutout circuit;

FIG. 2 is a diagrammatic plan view of the pulser rotor construction of the present invention;

FIG. 3 is a plan view of a magnetizing assembly for the pulser rotor of FIG. 2;

FIG. 4 discloses curves showing the operation of the rotor of FIG. 2;

FIG. 5 is a sectional view of the flywheel assembly for the ignition system of the present invention;

FIG. 6 is an end view of the flywheel assembly of FIG. 5;

FIG. 7 shows lockout time curves from the circuit of FIG. 1; and

FIG. 8 is a second embodiment of the ignition system of the present invention.

Figure 1:
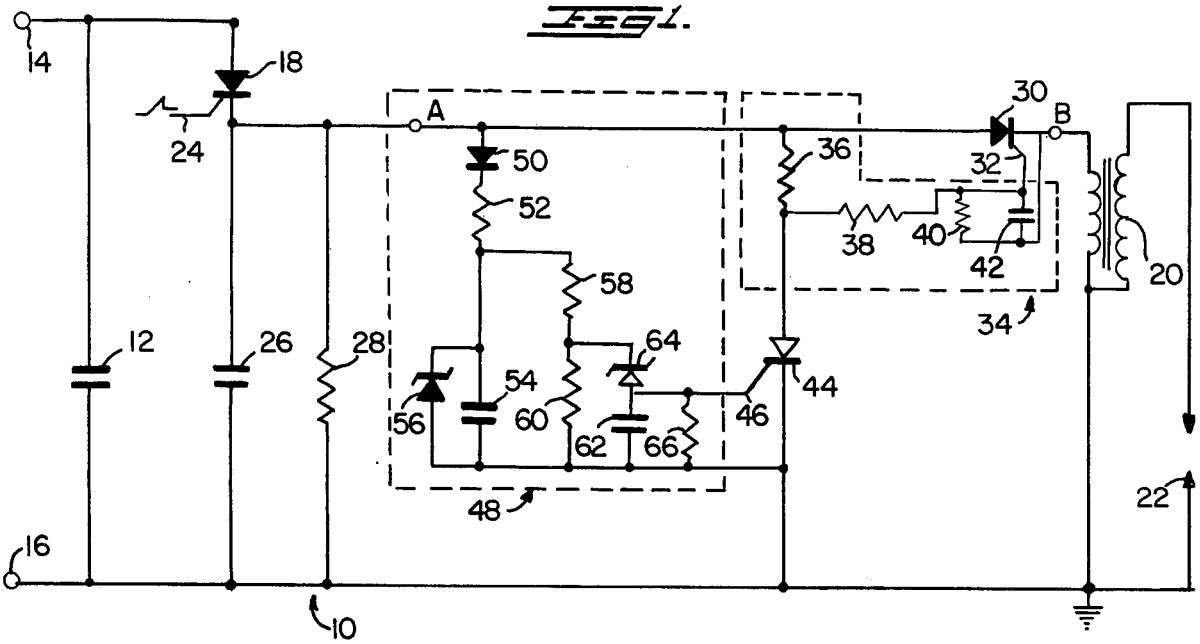
Referring now to FIG. 1, the ignition circuit of the present invention indicated generally at 10 includes an energy storage capacitor 12 which is connected across input terminals 14 and 16. These terminals are connected to a suitable charging source for the capacitor 12 of a type conventionally employed to charge the storage capacitor for a solid state capacitive discharge ignition system.

In a manner conventional to known capacitive discharge ignition systems, the capacitor 12 is connected through a solid state switch 18 which is formed by a thyristor in FIG. 1, to provide energy to an ignition transformer 20. This ignition transformer is a conventional step up transformer connected to fire a spark plug 22 when dischrge energy from the storage capacitor 12 is passed by the solid switch 18 to the ignition transformer. This occurs in response to trigger pulses provided to the gate 24 of the solid state switch 18 which initiate conduction of the switch and thus the discharge of the capacitor 12. These trigger pulses occur in timed relation to engine speed and may be provided by any one of many well known engine driven pulse producing systems. However, ideally these pulses will be provided by the improved pulser rotor of FIG. 2.

A capacitor 26 is connected in series with the anode-cathode circuit of the thyristor 18 to form a circuit in parallel with the capacitor 12 across the input terminals 14 and 16, while a resistor 28 is connected across the capacitor 26.

The components 14–28 of the ignition circuit 10 would form a standard capacitive discharge solid state ignition circuit if a direct electrical connection is made between points A and B and the remaining components of the circuit 10 are eliminated. This ignition system operates in a conventional manner so that energy is stored in the capacitor 12 during a charging cycle. Subsequently, a trigger pulse at the gate 24 causes the solid state switch 18 to conduct at a desired angular position in the rotational cycle of the internal combustion engine, thereby allowing energy stored in the capacitor 12 to be transferred to the ignition transformer 20. Voltage induced in the secondary of the ignition transformer is of sufficient magnitude to cause a spark to be developed across the electrodes of the spark plug 22, thereby initiating ignition and resulting in combustion of the fuel mixture within the internal combustion engine. The resistor 28, which is connected across the capacitor 26 and also across the primary of the transformer 20, provides a discharge path for energy stored in the capacitor 12 if the primary of the transformer 20 is inadvertently disconnected. Additionally, the capacitor 26 is connected to absorb transient voltages appearing across the primary of the transformer 20.

The solid state switch 30 consisting of a thyristor having a gate electrode 32 is connected between the output of the solid state switch 18 and the primary winding of the ignition transformer 20. The gate electrode 32 is connected to a trigger control unit 34. This trigger control unit connects the gate 32 to the anode circuit for the thyristor 30 and includes a resistor 36 and a resistor 38 connected to a parallel circuit consisting of a resistor 40 in parallel with a capacitor 42.

Connected in series with the resistor 36 across the primary winding of the transformer 20 is another thyristor solid state switch 44 having a gate electrode 46 which is connected to a timed interval lockout circuit 48. The timed interval lockout circuit includes a diode 50, a resistor 52 and a capacitor 54 connected in parallel with the resistor 36 and thyristor 44. A Zener diode 56 is connected across the capacitor 54.

Also connected across the capacitor 54 are series resistors 58 and 60, while a capacitor 62 and Zener diode 64 are connected across the resistor 60. The gate 46 of the thyristor 44 is connected between the capacitor 62 and and anode of the Zener diode 64, and a resistor 66 shunts the capacitor 62.

Broadly, the timed interval lockout circuit 48 operates to initiate a timed lockout interval after a voltage from the capacitor 12 is impressed on the resistor 28 by the discharge of the capacitor 12 through the thyristor 18. During this timed interval lockout period, the thyristor 44 is held in conduction to preclude the trigger control circuit 34 from initiating conduction of the thyristor 30. Therefore, if an engine overspeed condition exists and a trigger pulse on the gate 24 of the thyristor 18 occurs during the timed lockout interval, energy discharged by the capacitor 12 through the thyristor 18 will be shunted by the parallel circuits provided by resistor 28 and resistor 36 in series with the conducting thyristor 44, and no energy will be provided to the gate 32 of the thyristor 30. Thus the thyristor 30 blocks the flow of energy to the transformer 20 and provides a cutout switching means which is operable to selectively complete or open a circuit between the thyristor 18 and the transformer 20. This selective operation of the thyristor 30 is controlled in accordance with the energization and deenergization of the thyristor 44 which constitutes a shunt switch responsive to the timed interval lockout circuit 48.

A triggerable pulse at the gate 24 of the thyristor 18 causes energy previously stored in the energy storage capacitor 12 to be impressed upon the resistor 28. This voltage, after an initial time delay, causes the timed interval lockout circuit 48 to initiate a timed lockout interval. Depending upon the interval since the previous voltage pulse across the resistor 28, the voltage on capacitor 54 can be as low as zero or as high as the Zener voltage of the Zener diode 56 when thyristor 18 initially turns on. The Zener diode 56 provides the reference starting voltage for the timed lockout period.

Resistor 52 provides a series charging resistor for the capacitor 54, and is of such a resistance value that with maximum loading of the energy storage capacitor 12 (resistor 28 and transformer 20 both conducting) sufficient current will flow to charge capacitor 54 to the Zener voltage of the Zener diode 56 with minimum operating voltage on the capacitor 12. Thus, when the thyristor 18 conducts, capacitor 54 begins to charge, and when voltage across capacitor 54 exceeds the reference voltage of Zener diode 64, gate current flows to gate 46 of thyristor 44.

When the voltage across resistor 28 decays due to the discharge of energy storage capacitor 12, the capacitor 54 becomes an energy source discharging through the resistor 58, the resistor 60, and the Zener diode 64. The diode 50 operates to isolate capacitor 54 from resistor 28 during discharge. Resistor 58 serves as a current limiting resistor for the gate of the thyristor 44 and Zener diode 64 sets the reference final voltage for the timed lockout. Thus when the voltage across capacitor 26 decays below the voltage value set by Zener diode 56, capacitor 54 begins to discharge. Thyristor 44 is conductive until the voltage provided by capacitor 54 causes the voltage across resistor 58 to decay below the reference voltage set by the Zener diode 64.

The capacitor 62 provides a time delay for the conduction of the thyristor 44, and the gate of this thyristor will remain energized for a period determined by the capacitor 54, the resistors 58 and 60, Zener diode 64, and the resistor 66.

It is obvious that the discharge of the capacitor 54 causes conduction of the thyristor 44 for a time delay lockout period after the occurrence of a voltage pulse across the resistor 28. Should this lockout period still be in effect when a succeeding voltage pulse is provided across the resistor 28, trigger current will flow through the resistor 36 and then through the conducting thyristor 44. Thus trigger current will not be provided to the gate 32 of the thyristor 30, and this thyristor will not conduct to provide energy to the transformer 20.

On the other hand, if the interval provided by the timed interval lockout circuit 48 has expired before the thyristor 18 is caused to conduct by a pulse on the gate 24, trigger current flows through the resistor 36 and since the thyristor 44 is not conducting, is passed to the resistor 38 and parallel connected resistor 40 and capacitor 42 to the gate 32. This turns on the thyristor 30 and allows energy stored in the capacitor 12 to be transferred to the transformer 20. Capacitor 42 provides a slight time delay before the thyristor 30 is rendered conductive, while the time delay provided by the capacitor 62 insures that the thyristor 44 will not be turned on until after conduction of the thyristor 30.

From the above description, it is apparent that when an engine overspeed condition occurs causing pulses at the gate 24 to trigger conduction of the thyristor 18 at a rate higher than the desired rate set by the timed interval lockout unit 48, the energy from the capacitor 12 will be shunted by resistor 28 and through resistor 36 and thyristor 44 and will not reach the transformer 20. Since no spark is provided to the engine, the engine will slow to a controlled speed whereupon the thyristor 30 will again become energized to provide energy to the transformer 20.

Figure 2:
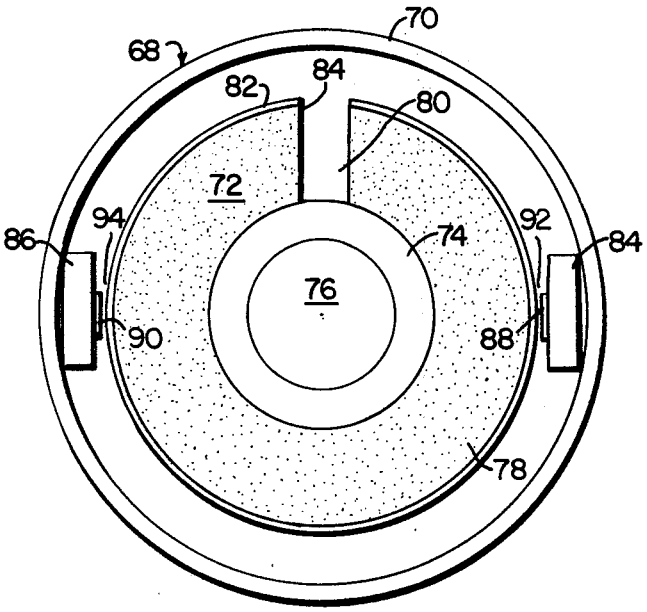

The trigger pulses at the gate 24 of the thyristor 18 of FIG. 1 are provided by a novel trigger pulse generating assembly indicated generally at 68 in FIG. 2. This assembly includes a flywheel 70 (FIGS. 5 and 6) which mounts a pulser rotor 72. The pulser rotor incorporates a central hub which fits into the hub of the flywheel 70 for the internal combustion engine. This causes the pulser rotor to rotate in direct timed relation to the speed of the internal combustion engine.

The pulser rotor 72 also includes a cylindrical body of permanent magnetic material 78 which surrounds the hub 74. This cylindrical body of permanent magnetic material is encased in a cylindrical metallic casing 80 formed of magnetic material. The magnetic body 78 of the rotor is broken by a slot 82 which extends through the casing 80 and the magnetic body 78 to the hub 74.

A pair of diametrically spaced trigger coils 84 and 86 are mounted within the confines of the flywheel 70. These coils include respective trigger coil cores 88 and 90. It will be noted that since the rotor 72 is circular in cross-section and centered relative to the flywheel and trigger coils, the arc gaps 92 and 94 between the cores 88 and 90 and the outer periphery of the rotor are always of equal size during rotor rotation.

The rotor 72 is designed to inhibit rotation of the engine in the reverse direction while still permitting the use of a symmetrically arranged rotor of circular cross-section. Instead of structurally varying the outline of the rotor as has been done in the prior art to provide a rotor outline which is a convolution of a spiral, thereby resulting in a varying air gap between the periphery of the rotor and the trigger coils, the present invention employs variation in the magnetization of the magnetic body 78. This may best be understood by reference to the diagram of FIG. 3 which illustrates a procedure for magnetizing the body 78 or pulser rotor 72 before it is incorporated into the trigger pulse generating assembly of FIG. 2. The magnetic body or pulser rotor is placed within two specially formed pole pieces 96 and 98 which operate to control the magentization of the magnetic body or rotor. Pole piece 96 is connected to receive magnetizing energy from a coil 100 while pole piece 98 receives energy from a coil 102. The magnetic body 78 or pulser rotor 72 is positioned within the pole pieces 96 and 98 in such a manner that maximum magnetization occurs on either side of the slot 82. Due to the tapering configuration of the pole pieces 96 and 98 which taper away from the respective coils 100 and 102, a resulting gradual reduction in the magnetization of the body 78 or rotor 72 will occur until the point of minimum magnetization at point 104 is reached. Also, it should be noted that the polarity of magnetization is different on each side of the slot 82.

Figure 3:
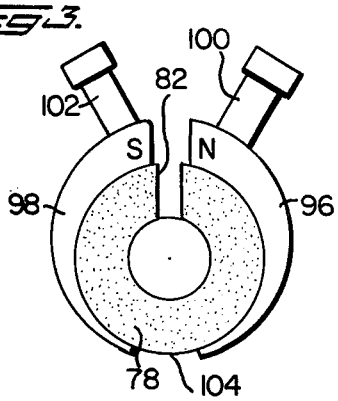
Figure 4:
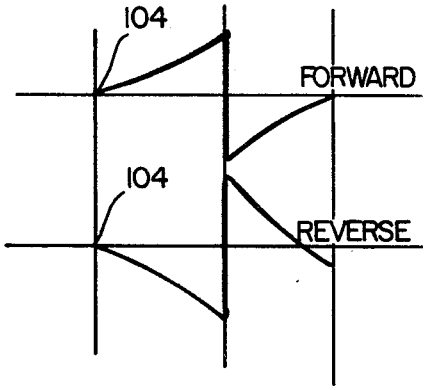

With the magnetic body 78 or pulser rotor 72 being magnetized in the manner illustrated by FIG. 3, a flux wave form of the type shown on the top line in FIG. 4 will occur in the core of a trigger coil when the rotor 72 rotates in a forward or clockwise direction (FIG. 2). However, reversal of the rotation will result in the reverse flux waveform shown at the bottom line of FIG. 4. It is therefore, possible through the use of polarity sensitive devices in a conventional manner to prevent triggering of the ignition circuit 10 when the rotor 72 is rotating in the reverse direction.

Figure 6:
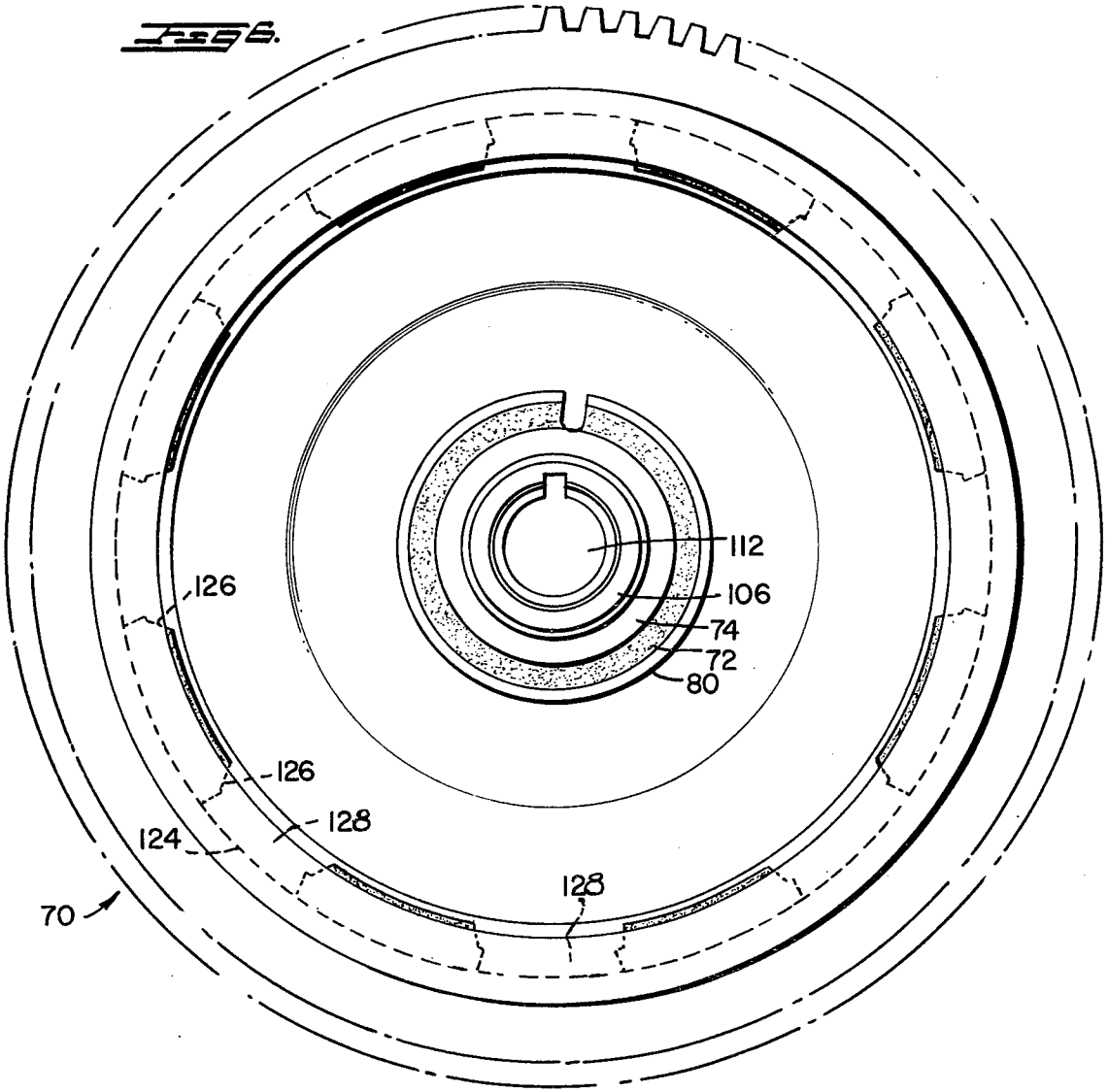
Figure 5:
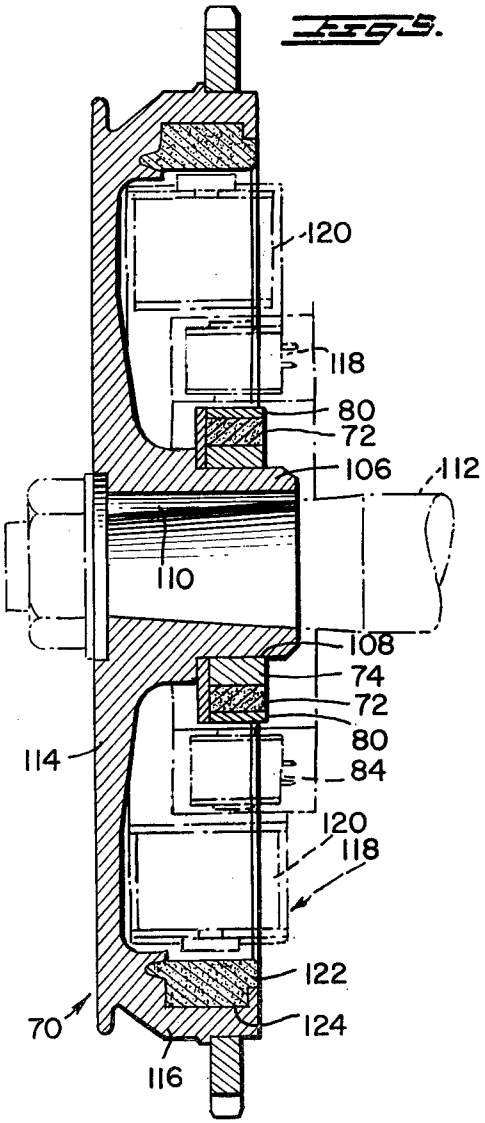

FIG. 2 provided a diagrammatic showing of the trigger pulse generating assembly 68, and FIGS. 5 and 6 provide a detailed showing of the manner in which the pulser rotor and trigger coils combine with the novel structure of the flywheel 70 and a stator assembly to provide an improved flux path to enhance the pulse generating capability of the trigger pulse generating assembly 68. The flywheel 70 is formed entirely of a material having a high flux conducting capability such as steel. The flywheel is circular in configuration and includes a central hub 106 which is cut away at its outer end to form a seat 108 for the hub 74 the pulser rotor 72. The pulser rotor is press fit onto the hub 106 and rotates with the flywheel 70. A keyed opening 110 through the hub of the flywheel receives a keyed drive shaft 112 for the internal combustion engine which drives the flywheel.

The hub 106 is formed at the center of a circular disc like body 114 for the flywheel and a flange 116 extends about the flywheel body at the periphery thereof so as to be coextensive and substantially parallel with the hub 106. The flange 116 and the hub 106 joined by the body 114 provide an open faced chamber which receives the trigger coils 84 and 86 and a stator assembly 118. The stator assembly is a circular assembly which is mounted within the confines of the hub 106 and flange 116 and which supports a plurality of evenly spaced stator coils 120. These stator coils cooperate in known manner with permanent magnets 122 mounted on the inner surface of the flange 116. The stator is symmetrically positioned to provide an equal air gap between all of the coils 120 and the magnets 122.

The trigger coils 84 and 86 are mounted upon a circular timing ring which is supported from a stationary support structure for the stator assembly. This combination of a circular stator structure and a circular timing ring for the trigger coils is a conventional structure employed in known ignition systems manufactured by the Fairbanks Morse Engine Accessories Division of Colt Industries, Operating Corp, Beloit, Wisconsin. A similar assembly is shown in U.S. Pat. No. 3,974,817 to Robert M. Henderson et al.

Other mounting arrangements may be employed to mount the stator 118 and the trigger coils 84 and 86 in stationary relationship to the rotating flywheel 70 within the confines of the hub 106 and flange 116. It should be noted however that the rotor 72, the trigger coils 84 and 86, and the stator 118 are maintained in very close proximity with each other and with the flywheel 70.

The flange 116 of the flywheel 70 is designed to provide a channel shaped seat 124 which receives the magnets 122. The magnets 122 are molded in place on the seat 124 in a manner best illustrated by FIG. 6. Here it will be noted that the permanent magnets 122 are equally spaced around the flange 116 of the flywheel 70 with poles thereof facing inwardly toward the hub 106 and arranged in alternating north-south relationship. The sides of each magnet are tapered inwardly as illustrated at 126 toward the inwardly facing pole face to provide a key for retaining the magnets against the seat 124. With the megnets in place, the spaces between the magnets are filled with epoxy resin as indicated at 128. When the epoxy hardens, it forms with the magnets 126 a unitary assembly mounted on the seat 124. The tapered edges 126 of the magnets permit the epoxy to hold the magnets firmly in place, and due to these tapered keys, the magnets are unaffected by shrinkage of the assembly. This provides a very effective magnetic assembly without requiring the use of mechanical keys of any type.

The novel design of the flywheel 70 provides a good flux path for the trigger assembly 68 which enhances the operation of the pulser rotor 72. By manufacturing the flywheel of flux conducting material and by maintaining the trigger coils, pulser rotor and stator assembly in close proximity to each other within the confines of the flywheel, an efficient flux path is formed back to the pulser rotor by the flywheel itself. This flux path begins at the pulser rotor and flows through the trigger coils 84 and 86. Some of the flux then returns from the trigger coils to the body of 114 of the flywheel. Other flux passes into the stator 118 and then back into the flywheel. The flywheel then provides a flux path through the body 114 and the hub 106 back to the pulser rotor 72. No such flux path is provided by previously known aluminum flywheels, and in some previously known steel flywheels where close proximity between the pulser rotor, the trigger coils, and the stator were not maintained, spider assemblies to conduct the flux back to the flywheel where required. These spider assemblies often upset the symmetry of the total assembly rotating with the flywheel. It will be noted that the combined flywheel and pulser rotor of the present invention provides a completely symmetrical rotating assembly.

Figure 7:
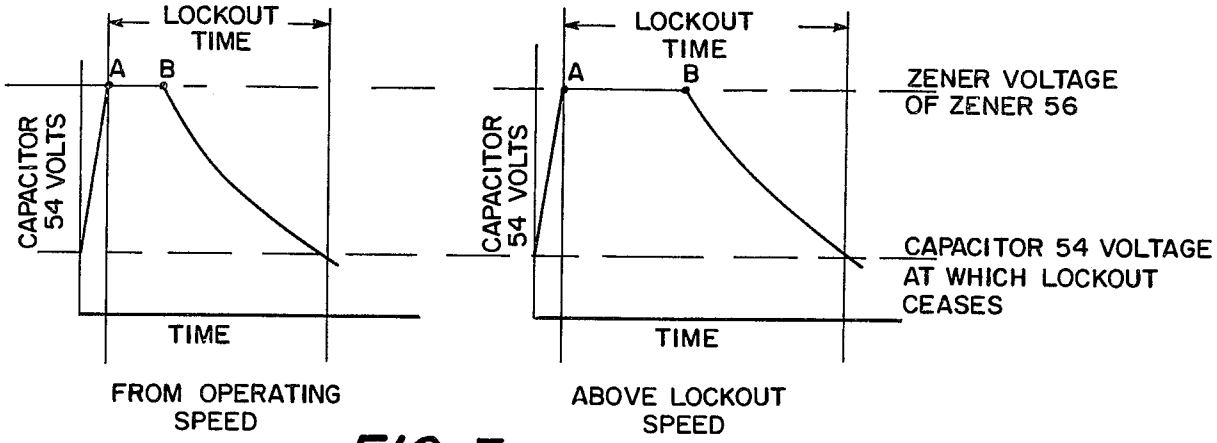

During normal operation of the ignition circuit 10 of FIG. 1, the impedance of the ignition transformer 20 is low compared to that of the resistor 28 and the resistor 52, capacitor 54, Zener diode 56, resistor 58 and Zener diode 64 of the timed interval lockout circuit 48. Thus a large majority of the energy from the capacitor 12 is transferred to the transformer 20 to to produce spark energy. However, during the lockout condition initiated by the timed interval lockout circuit 48, the transformer 20 is disconnected from the capacitor 12 and the energy from this capacitor is dissipated by the resistor 28 and the timed interval lockout circuit 48. Now the impedance across the capacitor 12 is higher than before, and the length of time that the capacitor 54 is being charged from the capacitor 12 is materially increased. As the lockout time is the sum of the time that it takes the capacitor 54 to discharge to a value that causes cessation of the gate current to the thyristor 44, it follows that the lockout time is longer when the controlled engine speed decreases from above lockout speed to normal operating speed than when the engine speed increases from operating speed to above lockout speed. This results in a dead band as illustrated by the curves of FIG. 7.

Figure 8:
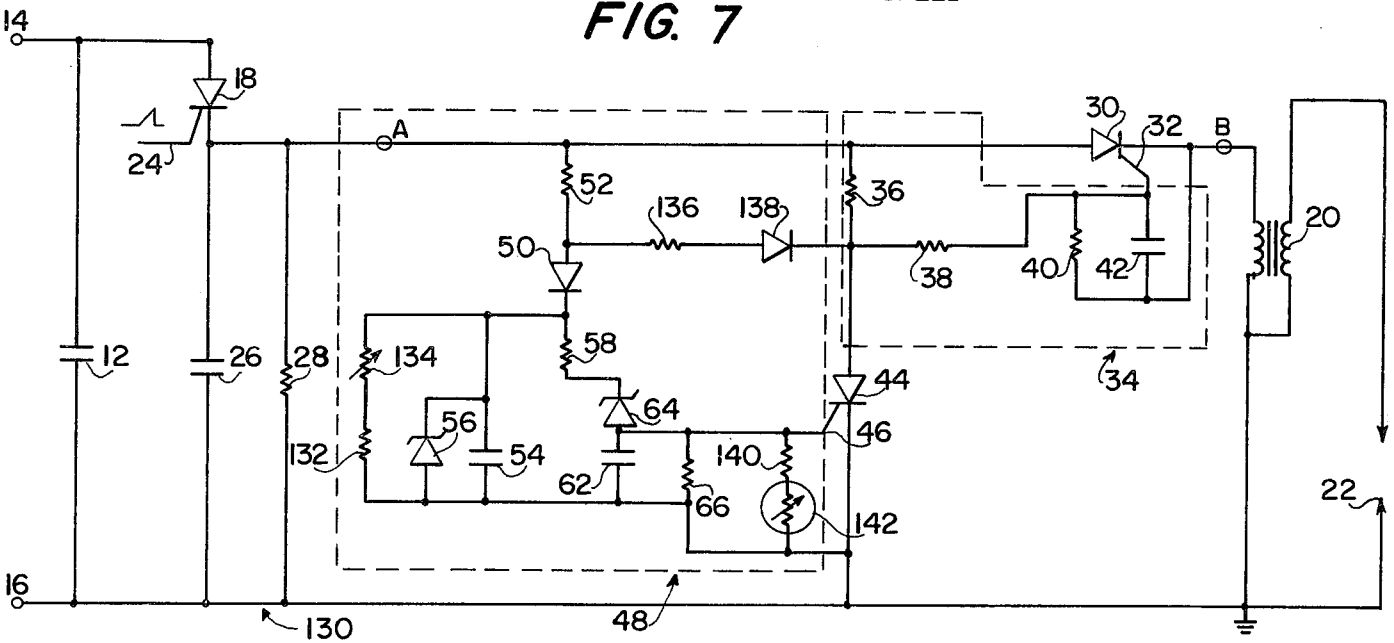

The ignition circuit 10 of FIG. 1 may be modified as exemplified by the ignition circuit 130 of FIG. 8, to reduce this dead band and also to adjust the lockout speed. Basically the ignition circuit 130 operates in the same manner as the ignition circuit 10, and like components are designated with the same reference numerals. It will be noted in FIG. 6 that the resistor 60 of FIG. 1 has been eliminated and that the series combination including the diode 50 and the resistor 52 has been reversed.

Series resistors 132 and 134, with the resistor 134 being a variable resistor, are connected across the series circuit formed by the resistor 58, the Zener diode 64 and the capacitor 62. These resistors are also connected across the shunt circuit formed by the capacitor 54 and the Zener diode 56.

A series circuit formed by a resistor 136 and a diode 138 is connected between the junction between the diode 50 and the resistor 52 and the junction between the resistor 36 and the thyristor 44. Also, a series circuit consisting of a resistor 140 and a thermistor 142 is connected to the gate electrode 46 of the thyristor 44 and shunts the resistor 66.

Turning now to the operation of the modified ignition circuit 130, the resistor 132, in combination with the other components of the lockout circuit 48 determines the maximum lockout speed for the engine with the variable resistor 144 set at zero ohms. However, this lockout speed may be varied by the variable resistor 134 which provides a maximum lockout speed when the resistance is at zero ohms and a minimum lockout speed with the resistance of 134 at an order of magnitude greater than the impedance of the series circuit consisting of the resistor 58 and the Zener diode 64. When the engine exceeds this lockout speed, the timed interval lockout circuit 48 prevents energy from the capacitor 12 from passing through the thyristor 30 to the transformer 20.

As previously explained with regard to the ignition circuit 10, during normal operation, the thyristor 30 is turned on before the thyristor 44 becomes conductive. During the turn on period of the thyristor 30, the voltage at the connection point between the resistors 36 and 38 is that formed by the voltage divider action of these resistors and is considerably higher than the voltage at the anode of the diode 50. However, after the thyristor 30 turns on and subsequently the thyristor 44 turns on, the voltage at the connection point between the resistors 36 and 38 is nearly at ground potential, and the voltage at the anode of the diode 50 is lowered by the voltage divider action of resistor 52 and the resistor 136. The source voltage from the capacitor 12 for the lockout circuit 48 will cease when the voltage at the anode of the diode 50 drops to the Zener voltage of the zener diode 56. This reduction is caused by the decrease in output voltage from the capacitor 12 resulting from the transfer of energy to the transformer 20.

During lockout operation, the thyristor 44 is on when the thyristor 18 turns on thereby rendering the thyristor 30 nonconductive. The source voltage for the lockout circuit 48 is reduced by action of the resistor 136 in parallel with the lockout circuit elements 54, 56, 58 and 64 which are in series with the resistor 52. The net effect is that the horizontal voltage times between points A and B in the two curves of FIG. 5 now become substantially the same, and the lockout time can be made substantially the same when increasing engine speed from normal operating speed to lockout speed or from above lockout speed to normal operating speed. This results in minimization of the previously existing dead band.

The diode 138 isolates the lockout circuit 48 from the anode of the thermistor 44 when voltage at the anode is higher than the lockout circuit voltage. Similarly, the diode 50 isolates the lockout circuit 48 from the remainder of the ignition circuit formed by the capacitor 12, the thyristor 18, the capacitor 26, the resistor 28 and the anode of the thyristor 44 when the lockout circuit voltage is higher than that in the remainder of the ignition circuit.

With increasing temperature, less gate current is required to initiate conduction of the thyristor 44, and also less voltage is required between the gate 46 and the cathode of the thyristor. The Zener diode 56 has a positive temperature coefficient while the Zener diode 64 may have either a positive or negative temperature coefficient and is relatively temperature insensitive. These factors operate to reduce the lockout speed set by the lockout circuit 48 with increasing temperature. However, the combination of the resistor 140 and the thermistor 142 provides additional gate to cathode shunting for the thyristor 44 with increasing temperature, and subsequently maintain the lockout speed set by the circuit 48 constant with temperature.

I claim:

1. An ignition system for an internal combustion engine comprising spark ignition means including an ignition transformer, an electrical energy source means operative to energize said spark ignition means by providing electrical energy to said ignition transformer, controlled switching means operatively connected between said electrical energy source means and said spark ignition means to selectively pass energy from said electrical energy source means to energize said spark ignition means, trigger means operative in timed relation to the speed of said internal combustion engine to activate said controlled switching means, said controlled switching means operating under the control of said trigger means to pass pulses of energy from said electrical energy source means to said ignition transformer in timed relation to engine speed, and overspeed cutout means connected between said controlled switching means and said ignition transformer, said overspeed cutout means operating to sense the time interval between pulses of energy passed by said controlled switching means and to open the circuit between said controlled switching means and said ignition transformer to prevent a pulse of energy from reaching said ignition transformer when the time interval between said pulse of energy and the next preceding pulse of energy is less than a predetermined time.

2. The ignition system of claim 1 wherein said overspeed cutout means includes cutout switching means connected between said controlled switching means and said ignition transformer, said cutout switching means being operable to selectively complete or open a circuit between said controlled switching means and said ignition transformer and timed interval lockout means connected to receive pulses of energy passed by said controlled switching means and operative in response to a pulse of energy to initiate a timed lockout period, said timed interval lockout means operating during said timed lockout period to cause said cutout switching means to open the circuit between said controlled switching means and said ignition transformer.

3. An ignition system for an internal combustion engine comprising an electrical energy source means operative to energize spark ignition means, controlled switching means operatively connected between said electrical energy source means and said spark ignition means to selectively pass energy from said electrical energy source means to energize said spark ignition means, trigger means operative in timed relation to the speed of said internal combustion engine to activate said controlled switching means, said controlled switching means operating under the control of said trigger means to pass pulses of energy from said electrical energy source means to said spark ignition means in timed relation to engine speed, and overspeed cutout means connected between said controlled switching means and said spark ignition means and operating to sense the time interval between pulses of energy passed by said controlled switching means and to prevent a pulse of energy from reaching said spark ignition means when the time interval between said pulse of energy and the next preceding pulse of energy is less than a predetermined time, said overspeed cutout means including cutout switching means connected between said controlled switching means and said spark ignition means, said cutout switching means being operable to selectively complete or open a circuit between said controlled switching means and said spark ignition means and timed interval lockout means connected to receive pulses of energy passed by said controlled switching means and operative in response to a pulse of energy to initiate a timed lockout period, said timed interval lockout means operating during said timed lockout period to cause said cutout switching means to open the circuit between said controlled switching means and said spark ignition means.

4. The ignition circuit of claim 3 wherein said cutout switching means includes an electronic switch operatively connected in series between said controlled switching means and said spark ignition means, said electronic switch including control electrode circuit means connected to receive energy pulses from said controlled switching means and operative in response to an energy pulse to cause said electronic switch to conduct to complete the circuit from said controlled switching means to said spark ignition means, said timed interval lockout means including shunt switch means connected to said control electrode circuit means and selectively operative to complete or break a shunt circuit for said energy pulses, said shunt switch means operating during said timed lockout period to complete the shunt circuit and prevent energy pulses from causing the control electrode circuit means for said electronic switch to initiate conduction of said electronic switch.

5. The ignition circuit of claim 4 wherein said overspeed cutout means includes capacitive timing circuit means which is charged by an energy pulse from said controlled switching means, said capacitive timing circuit means subsequently discharging energy between energy pulses to cause said shunt switch means to complete said shunt circuit for the timed lockout period, said shunt switch means including an electronic switch having control electrode circuit means connected to receive the discharged energy from said capacitive timing circuit means to render said electronic switch conductive.

6. The ignition circuit of claim 5 wherein the control electrode circuit means for the electronic switch of said shunt switch means includes time delay means to delay the conduction of said electronic switch for a period after the controlled switching means begins passing an energy pulse from said electrical energy source means.

7. The ignition circuit of claim 6 wherein the capacitive timing circuit means for said overspeed cutout means includes a capacitor connected to be charged by said energy pulse and a first voltage responsive means shunting said capacitor, said first voltage responsive means operating to determine the starting voltage for the timed lockout period, the control electrode circuit means for the electronic switch of said shunt switch means including a second voltage responsive means operating to determine the reference termination voltage for the timed lockout period, the conduction of the electronic switch of said shunt switch means being terminated when the discharged energy from said capacitive timing circuit means provides a voltage at said second voltage responsive means which is less than the reference termination voltage.

* * * * *